US012329287B2

(12) United States Patent
Li

(10) Patent No.: US 12,329,287 B2
(45) Date of Patent: Jun. 17, 2025

(54) DINING CHAIR

(71) Applicant: Shenzhen Autral Technology Innovation Co., Ltd., Shenzhen (CN)

(72) Inventor: Xuefeng Li, Shenzhen (CN)

(73) Assignee: SHENZHEN AUTRAL TECHNOLOGY INNOVATION CO., LTD., Shenzhen (CN)

( * ) Notice: Subject to any disclaimer, the term of this patent is extended or adjusted under 35 U.S.C. 154(b) by 185 days.

(21) Appl. No.: 18/244,294

(22) Filed: Sep. 11, 2023

(65) Prior Publication Data

US 2025/0072614 A1 Mar. 6, 2025

(30) Foreign Application Priority Data

Sep. 4, 2023 (CN) ..... 202311136621.8

(51) Int. Cl.

| | |
|---|---|
| ***A47C 3/38*** | (2006.01) |
| ***A47C 3/26*** | (2006.01) |
| ***A47C 4/04*** | (2006.01) |
| ***A47D 1/00*** | (2006.01) |

(52) U.S. Cl.

CPC ..... *A47C 3/38* (2013.01); *A47C 3/26* (2013.01); *A47C 4/04* (2013.01); *A47D 1/004* (2013.01)

(58) Field of Classification Search

CPC .... A47C 3/38; A47C 3/26; A47C 4/04; A47D 1/004; A47D 1/023

See application file for complete search history.

(56) References Cited

U.S. PATENT DOCUMENTS

| | | | | |
|---|---|---|---|---|
| 4,109,961 A * | 8/1978 | Opsvik | ..... | A47D 1/002 D6/350 |
| 2011/0095593 A1* | 4/2011 | Angelfoss | ..... | F16L 15/06 297/463.1 |
| 2025/0064226 A1* | 2/2025 | Tackaberry | ..... | A47D 1/0085 |

FOREIGN PATENT DOCUMENTS

| | | | | |
|---|---|---|---|---|
| CN | 201595459 U * | 10/2010 | | |
| CN | 217510178 U * | 9/2022 | | |
| DE | 29820578 U1 * | 3/1999 | ..... | A47D 1/004 |
| WO | WO-2014082455 A1 * | 6/2014 | ..... | A47D 1/002 |
| WO | WO-2020119499 A1 * | 6/2020 | ..... | A47D 1/004 |

* cited by examiner

*Primary Examiner* — Milton Nelson, Jr.

(57) ABSTRACT

A dining chair includes: a pair of support legs having inner surfaces, the inner surfaces defining a pair of slide grooves, each of the slide grooves extending along a direction that is parallel to a surface; a seat having a front end, a rear end, and two opposite sides between the front end and the rear end, one of the sides including a first side, a second side, and a shoulder formed between the first and second sides, the first side slidably received in one of the slide grooves, and the shoulder abutting against a closed end of the one of the slide grooves; and a locking mechanism fixed to the seat adjacent to the one of the sides of the seat, the locking mechanism including a locking member that is to move past the second side and abut against a rear end face of one of the support legs.

9 Claims, 12 Drawing Sheets

DINING CHAIR

CROSS REFERENCE TO RELATED APPLICATIONS

The present application claims priority to Chinese Patent Application No. 202311136621.8, filed Sep. 4, 2023, which is hereby incorporated by reference herein as if set forth in its entirety.

TECHNICAL FIELD

The present disclosure generally relates to dining chairs, and particularly to a dining chair with one or more height-adjustable seats.

BACKGROUND

Some conventional dining chairs are sold in pre-determined sizes and shapes. That is, the conventional dining chairs are designed for specific environments and users, which cannot adapt to users of different heights or special needs. For example, some dining high chairs for children have a seat with fixed height, which cannot adapt to children of different heights. The conventional dining chairs have limited adaptability.

Therefore, there is a need to provide a new dining chair to overcome the above-mentioned problem.

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
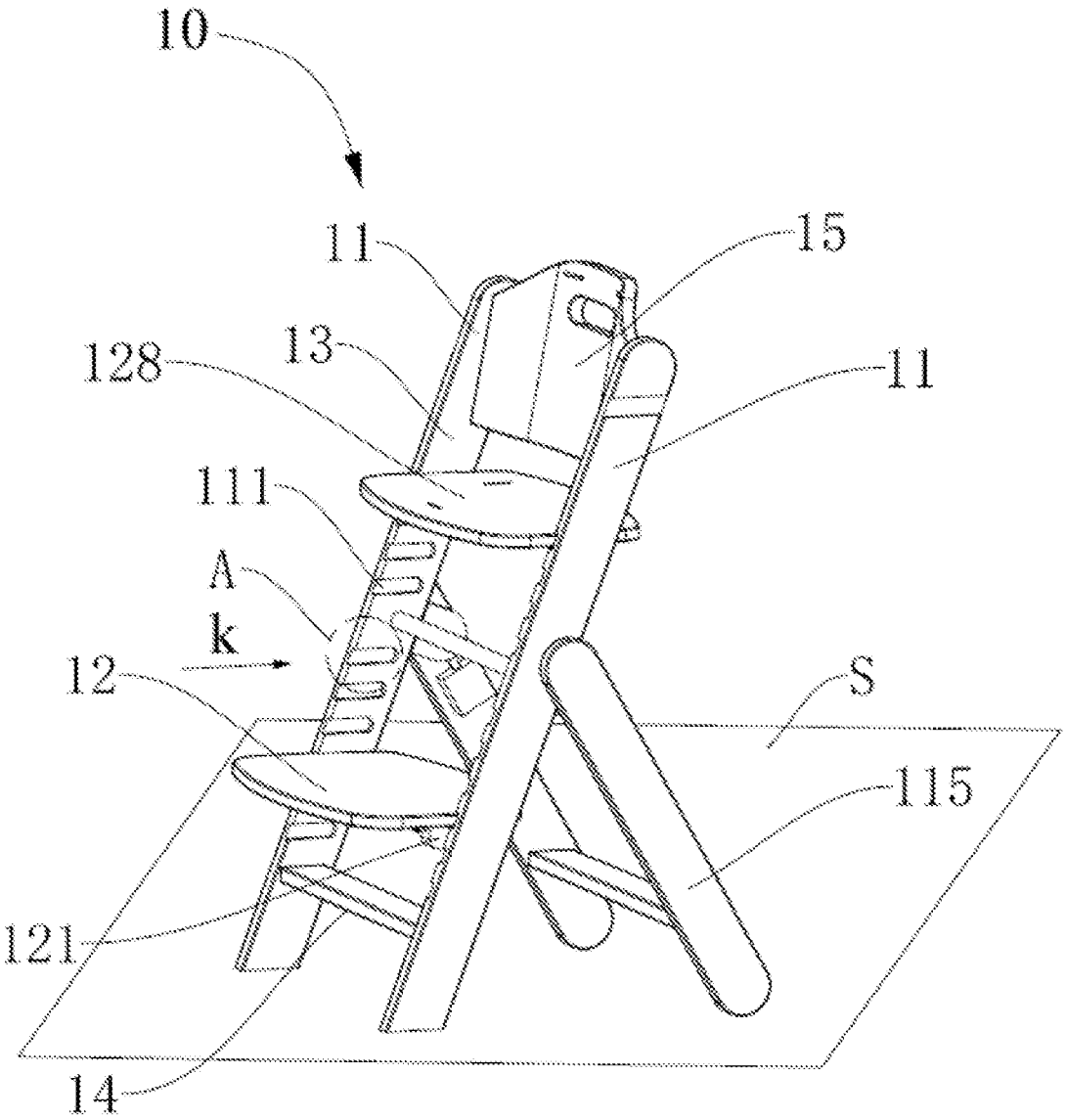
FIG. 1 is an isometric view of a dining chair according to one embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

Figure 2:
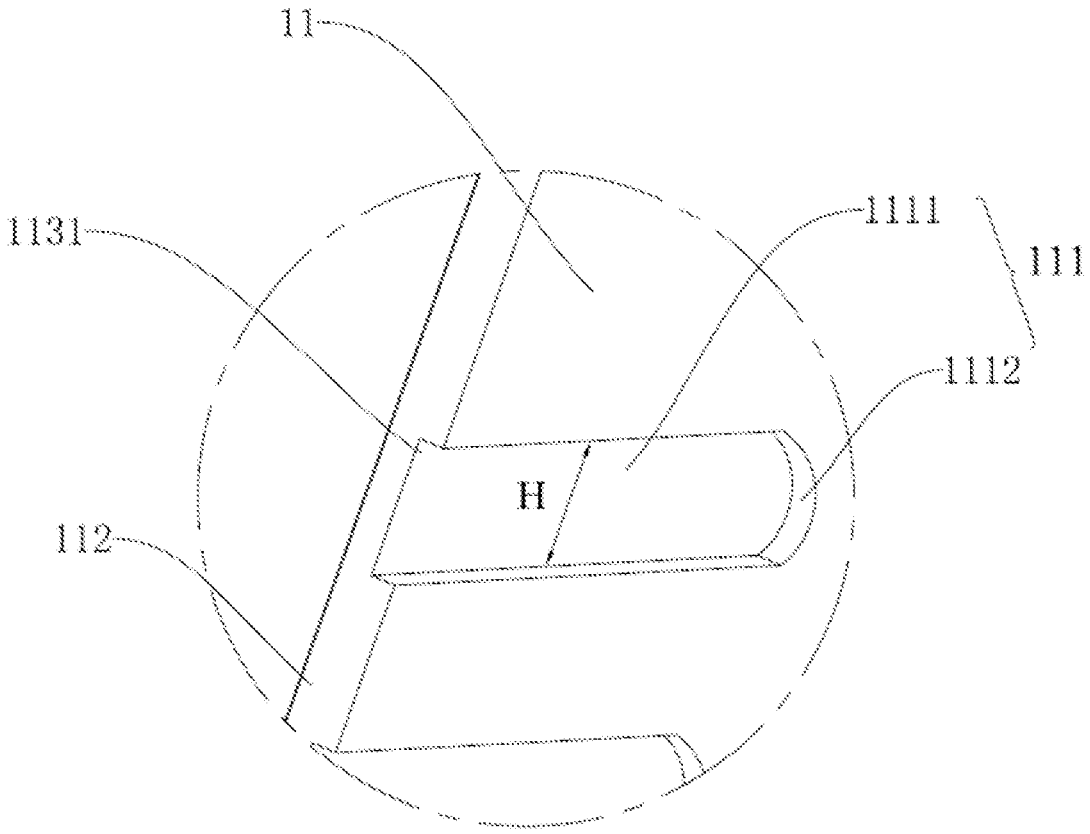
FIG. 2 is an enlarged view of a portion A in FIG. 1.
Figure 3:
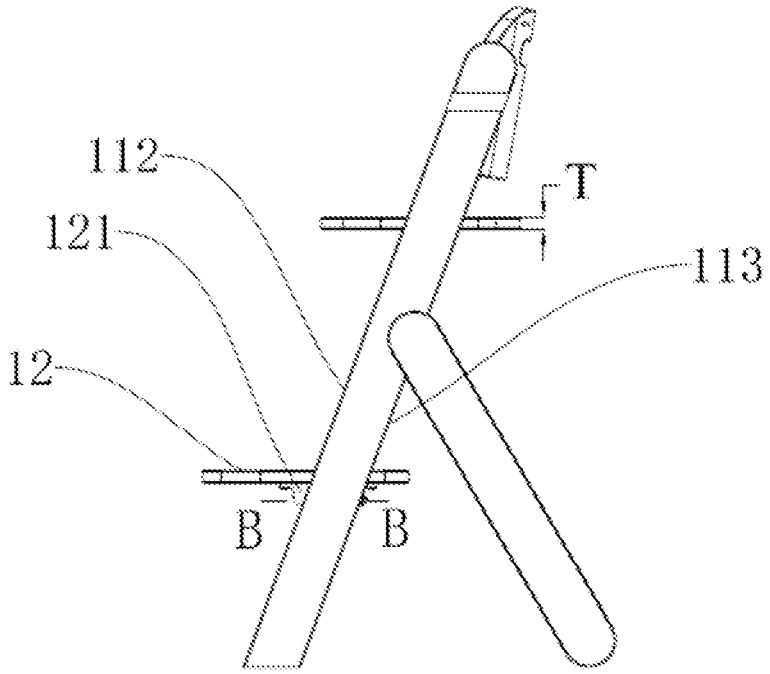
FIG. 3 is a planar side view of the dining chair.

Referring to FIGS. 1-3, in one embodiment, a dining chair 10 may include a pair of support legs 11 and one or more seats 12 detachably connected to the support legs 11. The support legs 11 are spaced apart from and substantially parallel to each other and the one or more seats 12 are arranged between the support legs 11. In one embodiment, each seat 12 is a flat board and the seats 12 of different heights can serve as a tray for placing food and drinks and a footrest for the user's feet, providing additional support and comfort. Seats 12 of different shapes or different numbers of seats 12 can be installed according to different needs. For the two support legs 11, each support leg 11 has an inner surface 13 facing the other support leg 11, and the inner surface 13 of each support leg 11 is provided with at least two slide grooves 111 arranged along the lengthwise direction of the support leg 11. Each slide groove 111 extend along a direction that is parallel to a surface S (e.g., floor) where the support legs 11 rest. The direction is indicated by an arrow k in FIG. 1. In one embodiment, each slide groove 111 has an open end at a front face 112 of the support leg 11, and a closed end 1112 adjacent to a rear face 113 of the support leg 11.

Figure 4:
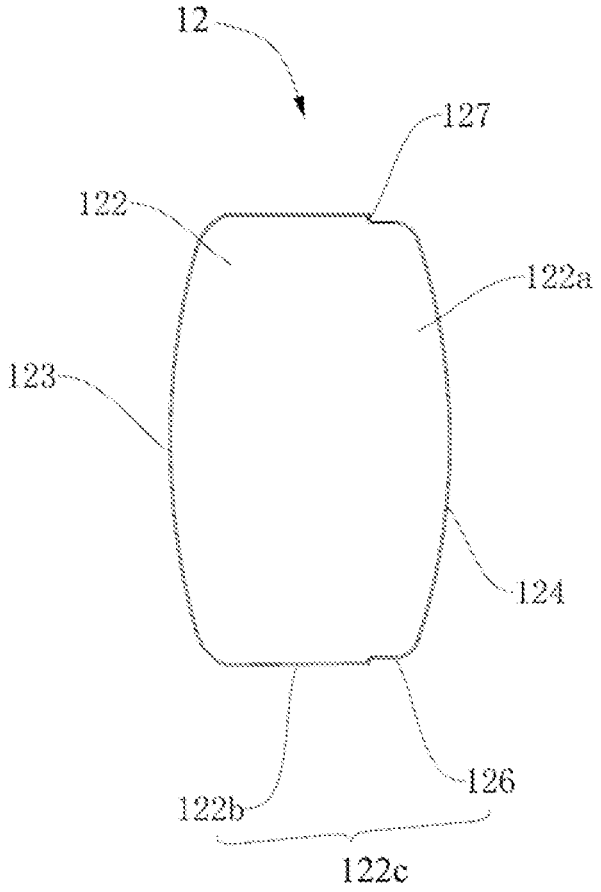
FIG. 4 is a planar top view of a seat of the dining chair.
Figure 5:
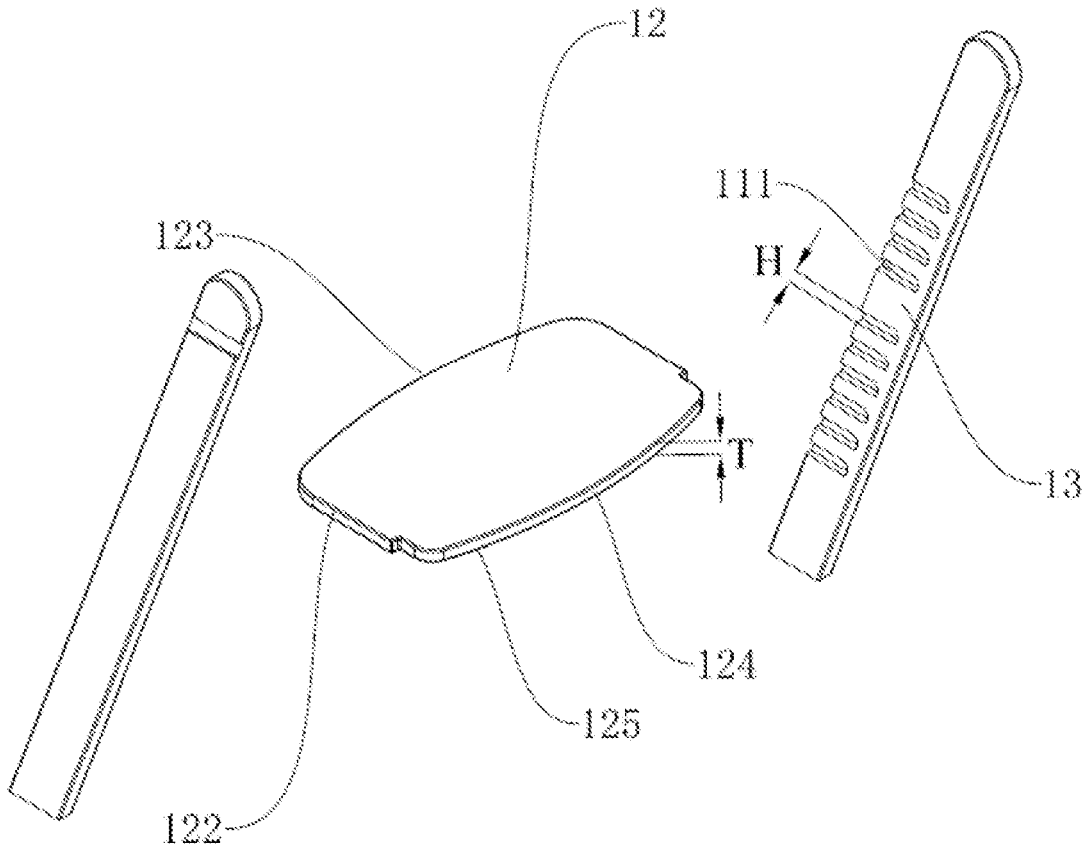
FIG. 5 is an isometric exploded view of the dining chair.
Figure 6:
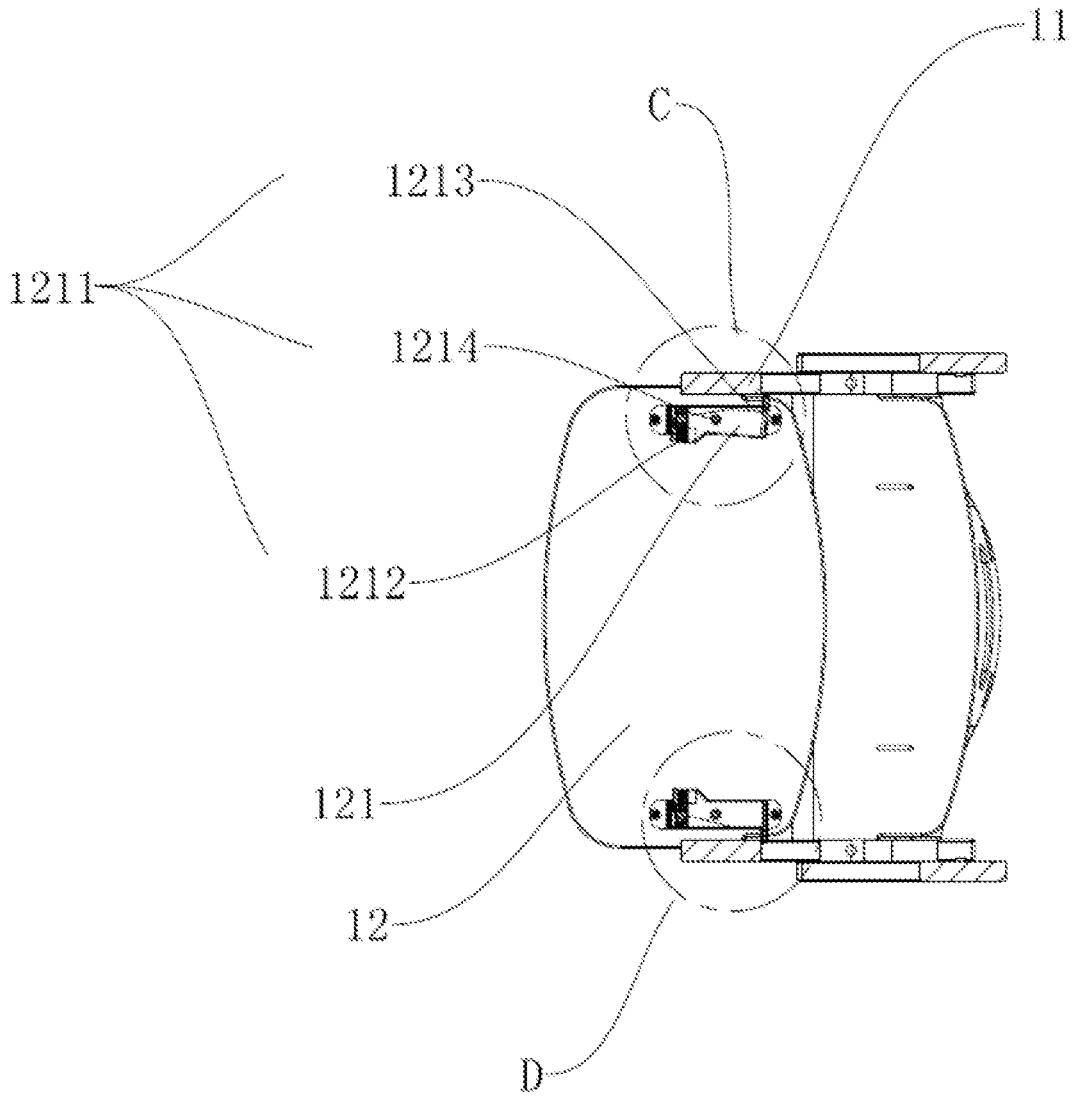
FIG. 6 is a cross-sectional view of the dining chair taken along lines B-B in FIG. 3.

In one embodiment, in the two support legs 11 facing each other, a number of slide grooves 111 extending along the horizontal direction are provided in the inner surfaces 13 of the support legs 11, and one seat 12 can be inserted into slide grooves 111 of different heights such that the seat 12 can be located at different heights according to actual needs. Referring to FIGS. 4-6, in one embodiment, the seat 12 may include a first board 122 and a second board 122*a*. The first board 122 has a larger width than the second board 122*a*. Opposite sides of the seat 12 can be inserted into a slide groove 111 through its open end. The slide groove 111 can prevent the seat 12 from moving vertically. Each slide groove 111 may include a vertical side surface 1111 that joins the closed end 1112. When opposite sides of the seat 12 are inserted into two slide grooves 111, the opposite sides of the seat 12 slide along the slide grooves 111 until the seat 12 comes into contact with the closed end 1112. In one embodiment, the inserting direction of the seat 12 is from the open ends of the slide grooves 111 toward the closed ends 1112, until the seat 12 abuts against the closed ends 1112 of the slide grooves 111. In this case, the seat 12 has moved to a desired position. The seat 12 is held in position by the two support legs 11. In one embodiment, the distance between the vertical side surfaces 1111 of one pair of slide grooves 111 is equal to the width of the first board 122. The insertion direction of the seat 12 is from the front of the dining chair to the back of the dining chair. In other words, the insertion direction of seat 12 is from front to back. The closed end of each slide groove 11*l* is a rear end of the slide groove 111. For each slide groove 111, the slide groove 111 is closed on one side of the rear face 113 of a corresponding support leg 11, and open on one side of the front face 112 of the corresponding support leg 11. For each support leg 11, multiple notches 1131 corresponding to slide grooves 111 are defined in the front face 112 of the support leg 11, and the rear face 113 of the support leg 11 is intact.

It should be noted that the front face 112 and rear face 113 are described based on the insertion direction of the seat 12.

If the insertion direction of the seat 12 changes, the face 112 will be referred to as a rear face and the face 113 will be referred to as a front face.

In one embodiment, the seat 12 may include a front end 123 and a rear end 124. The front end 123 is one end of the first board 122, and the rear end 124 is one end of the second board 122*a*. The first board 122 includes two opposite sides 122*b*. The two sides 122*b* can slide forward and backward in two slide grooves 111 of the two support legs 11, respectively. In one embodiment, the second board 122*a* includes two opposite sides 126. The sides 122*b* and the sides 126 are collectively referred to as the opposite sides 122*c* of the seat 12. Since the distance between the opposite sides 122*b* of the first board 122 (i.e., the width of the first board 122) is greater than the distance between the opposite sides 126 of the second board 122*a* (i.e., the width of the second board 122*a*), two shoulders 127 are formed between the sides 122*b* and the sides 126. When the shoulders 127 come into contact with the closed ends 1112 of two slide grooves 111, the movement of the seat 12 with respect to the slide grooves 11*l* is stopped. The design of the sides 126 allows the sides 126 of the seat 12 to closely abut against the inner surfaces 13 of the support legs 11, while avoiding the closed ends 1112 of the slide grooves 111 to better fit the seat 12 into the slide grooves 111.

In one embodiment, the thickness T of seat 12 is less than or equal to the height H of the slide grooves 111. In order to ensure the stability of the insertion of the seat 12, in another embodiment, the thickness T of the seat 12 may be equal to the height H of the slide grooves 111.

In one embodiment, at least one locking mechanism 121 is fixed to the seat 12. Specifically, referring to FIGS. 7-10, the locking mechanism 121 may include a base 1210 that can be fixed to the lower surface 125 (see FIG. 5) of the seat 12 by fasteners (e.g., screws). That is, the base 1210 can move together with the seat 12. The locking mechanism 121 may further include a locking member 1211 that is to move past one side 126 and abut against the rear face 113 of one support leg 11. In one embodiment, the locking member 1211 may include a first end 1212 that is to receive an external force and an opposite, second end 1213 that is to abut against the rear face 113 of one support leg 111. The first end 1212 and the second end 1213 are rotatable about a positioning hole 1214. In one embodiment, the locking member 1211 is rotatably connected to the base 1210 by a fastener (e.g., a screw, a pin, etc.) passing through the positioning hole 1214. The central axis of the positioning hole 1214 can thus be the axis of rotation L of the first end 1212 and the second end 1213. As a result, when a pushing force is applied to the first end 1212, the second end 1213 can move toward or away from one support leg 11. Specifically, the second end 1213 moves toward the rear face 113 of one support leg 11 when the first end 1212 moves away from the support leg 11.

When the seat 12 moves to a desired position, the second end 1213 of the locking member 1211 can be moved to abut against the rear face 113 of one support leg 11. Engagement of the shoulder 127 with the closed end 1112 of one slide groove Ill and engagement of the locking member 1211 with the rear face 113 of one support leg 11 prevent a relative movement of the seat 12 with respect to the support legs 11.

In one embodiment, the locking mechanism 121 may be fixed to the lower surface of the seat 12 in a vertical direction adjacent to one side 122*b* of the seat 12.

Figure 7:
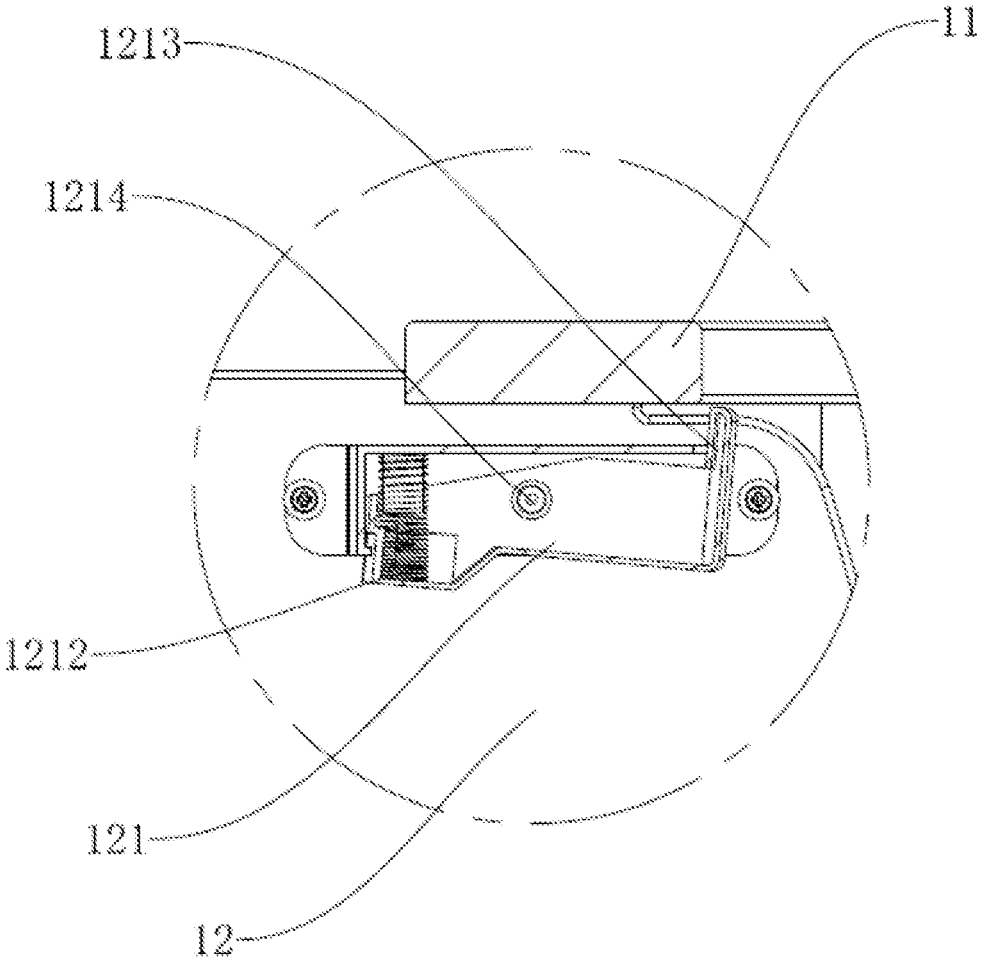
FIG. 7 is an enlarged view of a portion C in FIG. 6.
Figure 8:
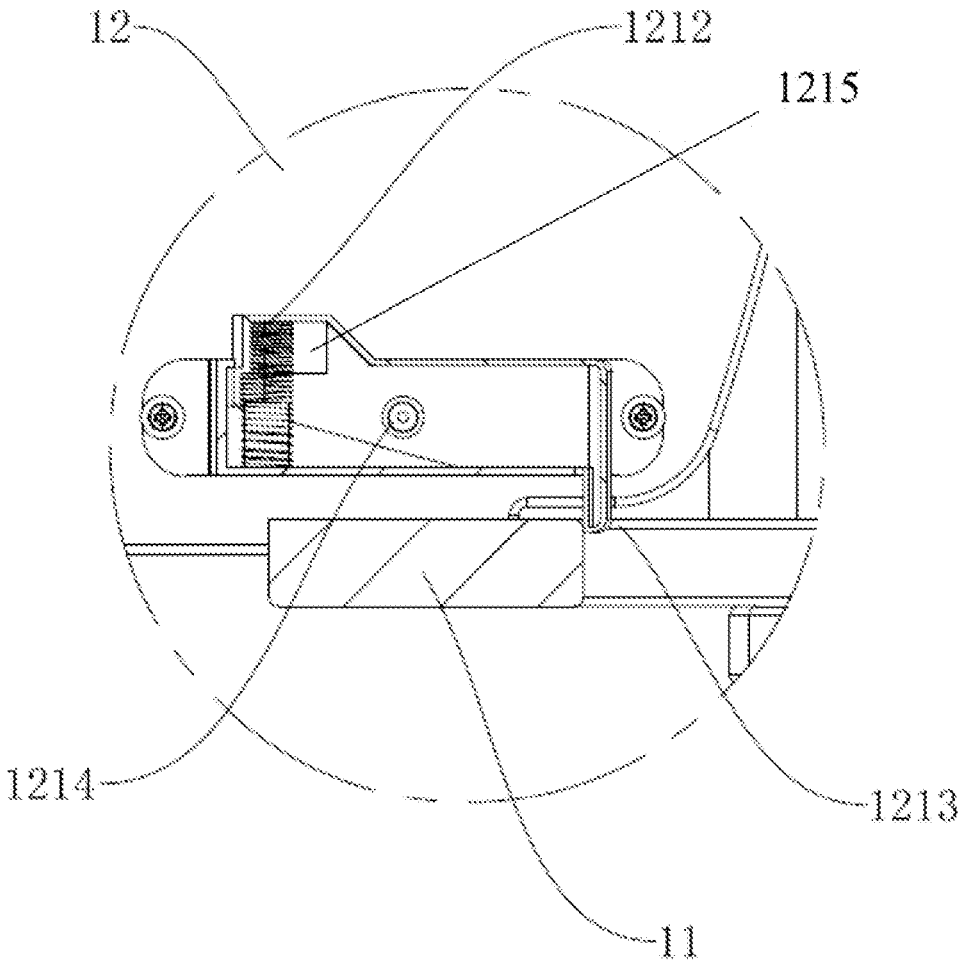
FIG. 8 is an enlarged view of a portion D in FIG. 6.
Figure 9:
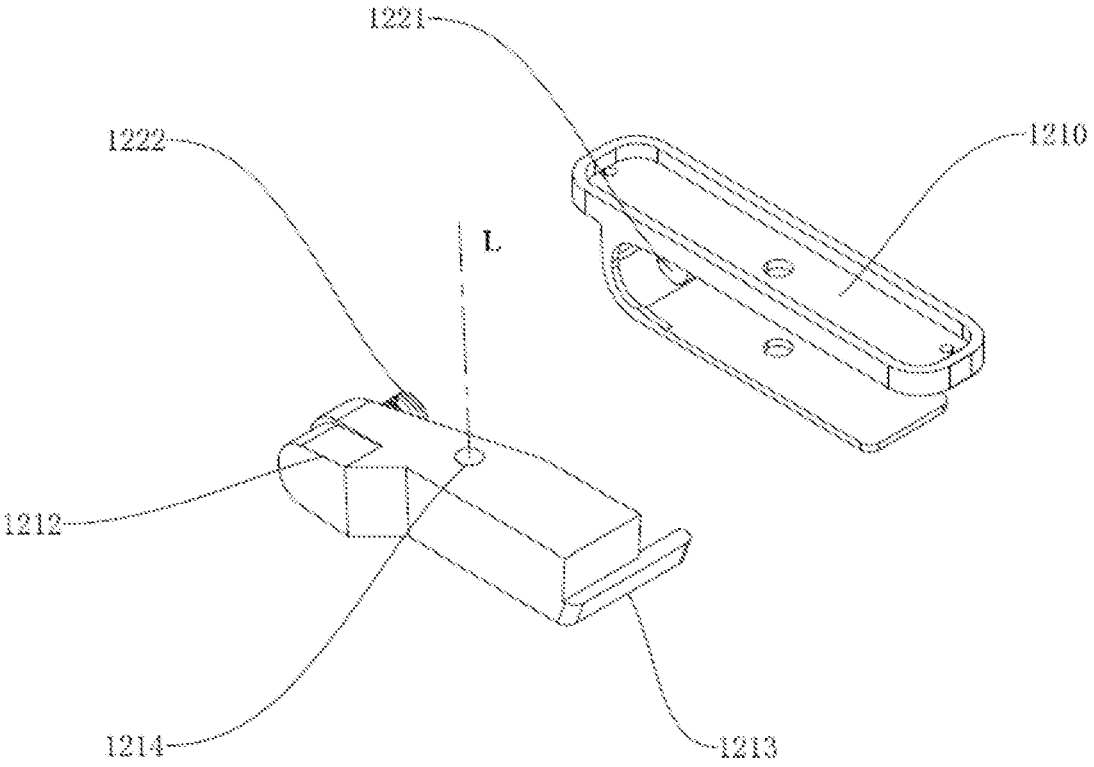
FIG. 9 is an isometric view of a locking mechanism of the dining chair according to one embodiment.
Figure 10:
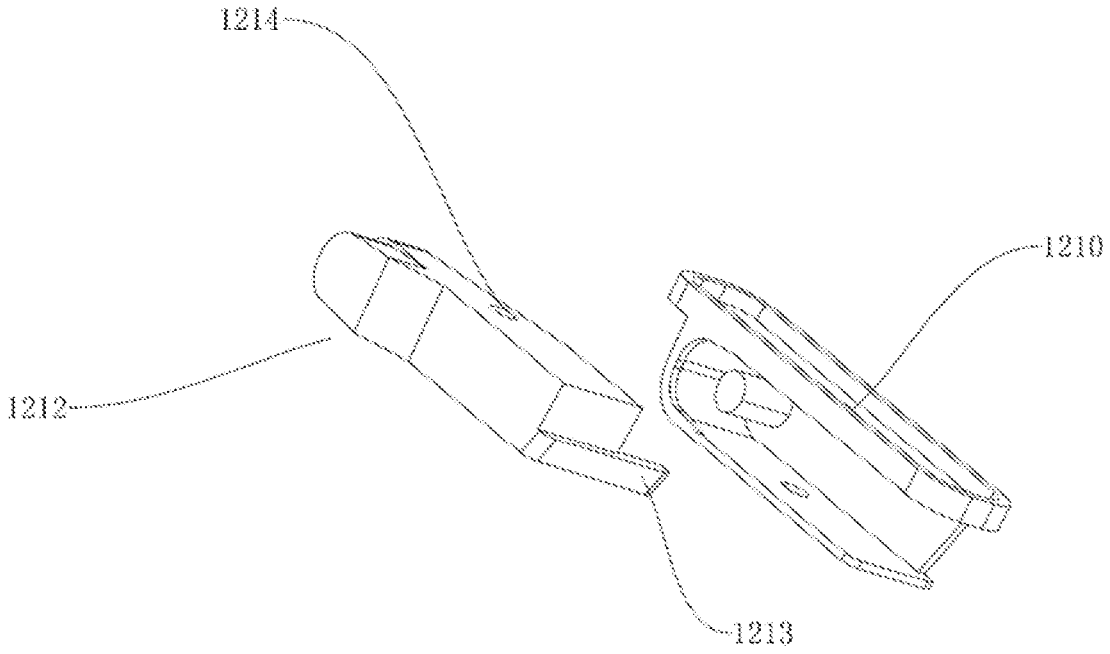
FIG. 10 is another isometric view of a locking mechanism of the dining chair according to one embodiment.

FIGS. 7 and 8 show different states of the locking member 1211. In FIG. 7, the second end 1213 of the locking member 1211 is not in contact with the rear face 113 of one support leg 11, which allows the seat 12 to move respect to the support legs 11. In FIG. 8, the second end 1213 of the locking member 1211 is in contact with the rear face 113 of one support leg 11. Thus, the seat 12 cannot move to the left in FIG. 8. In other words, the seat 12 cannot move toward the front face of the support leg 11. In addition to this, engagement of the shoulder 127 with the closed end 1112 of one slide groove 111 prevents the seat 12 from moving toward the rear face of the support leg 11. Thus, the seat 12 is locked in the position as shown in FIG. 8.

In one embodiment, the base 1210 includes a positioning post 1221. The first end 1212 of the locking member 1211 defines a hollow space 1215 that allows the first end 12121 to be arrange around the positioning post 1221. A coil spring 1222 is received in the hollow space 1215 and arranged around the positioning post 1221. Opposite ends of the coil spring 1222 abut against the locking member 1211 and the base 1210. When a user presses the first end 1212, the first end 1212 rotates toward the base 1210, thereby compressing the spring 1222. In the meantime, the second end 1213 of the locking member 1211 rotates away from the base 1210, and is not in contact with the rear face 113 of the leg 11 adjacent to the locking member 1211. In this case, the seat 12 is free to move along two slide grooves 111 with respect to the legs 11. The seat 12 can thus be connected to or removed from the legs 11. When the seat 12 moves to a desired position, the user can release the first end 1212, and the pressure on the first end 1212 disappears. The spring 1222 rebounds and drives the first end 1212 away from the base 1210, thereby causing the second end 1213 to be rotated to a position where the second end 1213 abuts against the rear face 113 of the support leg 11. Since the locking member 1211 is fixed to the seat 12, the second end 1213 of locking member 1211 abutting against the rear face 113 and the shoulders 127 of the seat abutting against the closed ends 1112 of two slide grooves III of the support legs 11 prevent the movement of the seat 12 along the slide grooves 111 as a whole. When not subjected to an external force (e.g., when the user releases the first end 1212), the spring 1222 has a tendency to maintain its original state, so that the first end 1212 of the support member 1211 is always in a state away from the base 1210. Therefore, the second end 1213 of the locking member 1211 is driven to be in an extended state, thus achieving self-locking of the seat 12.

In another embodiment, due to the fact that the seat 12 is inserted into two slide grooves 111 of the two opposite support legs 11, two locking mechanisms 121 may be mounted on the seat 12, and the two locking mechanisms 121 are independently controlled.

In one embodiment, the dining chair may further include one or more second seats 128, and the number of the second seats 128 can change according to actual needs. It should be noted that the shape of each second seat 128 can be the same as or different from the seat 12. The mounting manner of the second seat 128 can be different from or the same as that of the seat 12. By combining the seat 12 and the second seat 128, a dining chair with both a seat and a footrest can be provided. By combining the seat 12 and two second seats 128, a dining chair with a seat, a footrest and a tray for placing food and drinks can be provided.

In another embodiment, the second seat 128 may serves as a seat for a user to sit, and the seat 12 may serve as a footrest. In this case, the upper surface of seat 12 may be provided with a recess in the shape of human feet to accommodate the user's feet and prevent their feet from sliding off the footrest.

In order to make the support legs 11 more stable, the dining chair may further include a pair of secondary legs 115 that are tilted relative to the support legs 11. The support legs 11 and the secondary legs 115 form a triangle relative to the surface S, thereby allowing the dining chair 10 to stably rest on the surface S.

In another embodiment, in order to further maintain the stability of the support legs 11, at least one connecting rod 14 is arranged between and connected to the two support legs 11 such that the spacing of the support legs 11 remains unchanged. In one embodiment, the dining chair may further include a backrest at the top of the support legs 11.

Figure 11:
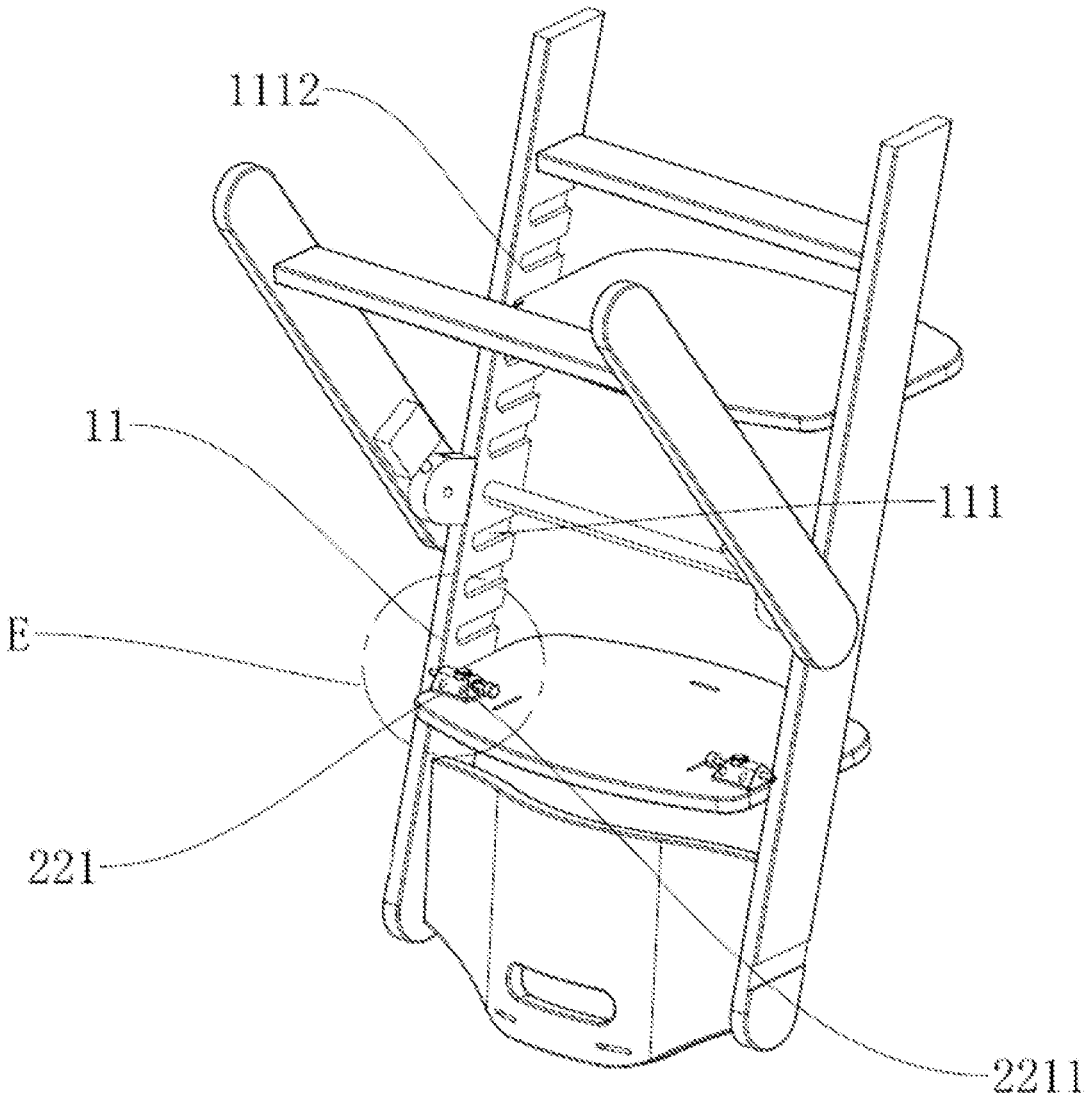
FIG. 11 is an isometric view of a dining chair according to another embodiment.
Figure 12:
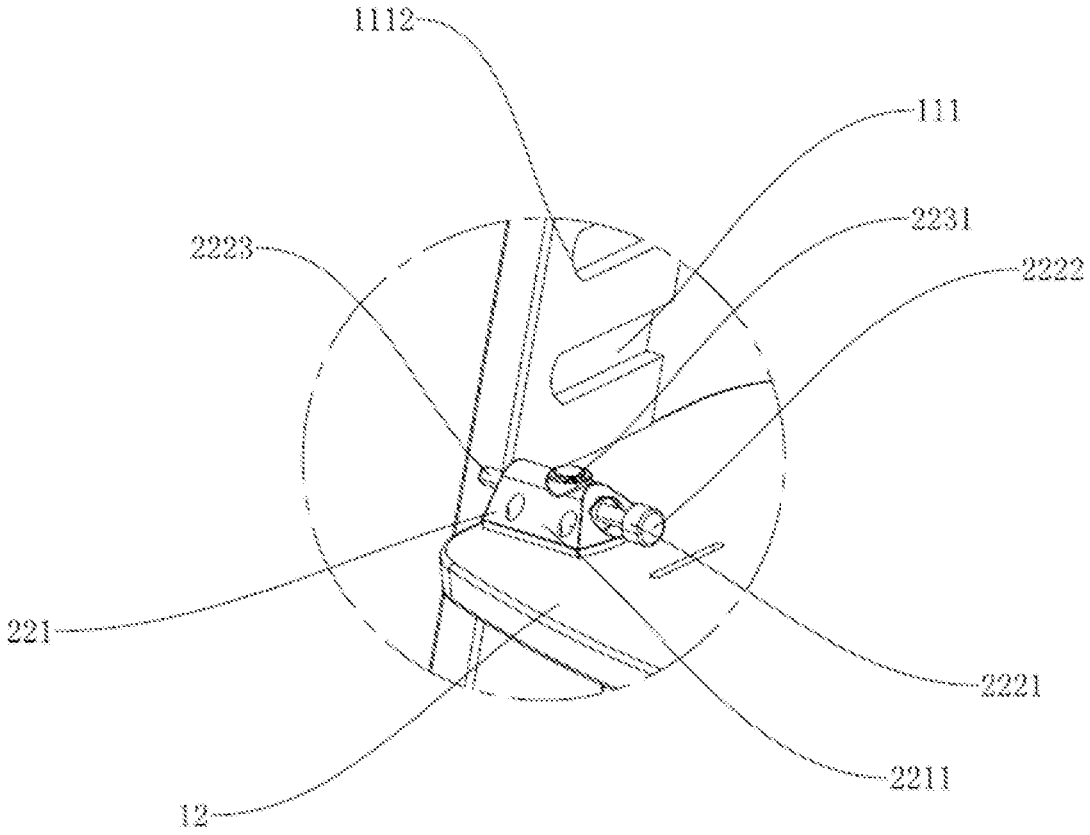
FIG. 12 is an enlarged view of a portion E in FIG. 11.

FIGS. 11 and 12 show a dining chair 10*a* according to another embodiment. The dining chairs 10 and 10*a* differ in that the dining chair 10 includes a different locking mechanism 221 that is constructed based on a different principle. Specifically, the locking mechanism 221 includes a base 2211 and a locking member 2221 that runs through the base 2211. The diameter of a first end 2222 of the locking member 2221 is greater than the diameter of an opposite, second end 2223 of the locking member 2221. When the first end 2222 is pushed, it drives the second end 2223 to move toward one support leg 11. When the second end 2223 moves to a position where the second end 2223 abuts against the rear face 1113 of the support leg 11, engagement of the shoulders 127 with the closed ends 1112 of the slide grooves 111 and engagement of the locking member 2221 with the rear face 113 of the support leg prevent a relative movement of the seat 12 with respect to the support legs 11, thereby locking the seat 12 in position.

In one embodiment, in order to ensure that the locking member 2221 is in a stable extended state, the locking mechanism 221 further includes a pin 2231. After the second end 2223 of the locking member 2221 abuts against the rear face 1113, the pin 2231 tightly locks the locking member 2221 on the base 2221, thereby allowing the second end 2223 to stay in contact with the rear face 1113. In this case, if it needs to unlock the locking mechanism 221 to remove the seat plate 12, a user can manually remove the pin 2231 and pull the locking member 2221 such the second end 2223 can disengage from the rear face 1113.

In another embodiment, the pin 2231 can be equipped with a spring to form a spring-loaded pin, thereby improving the convenience of operation. When pressed, the locking state of locking member 2221 can be switched.

In another embodiment, a spring may be arranged inside the base 2211 to maintain the stable locking of the locking member 2221 in an extended state without external force.

In another embodiment, the locking member 2221 can be threadly connected to the base. A user can rotate the locking member 2221 such that the second end 2223 can move toward or away from the rear face 1113, thereby improving the stability of the locking member 2221.

It should also be noted that multiple seats 12 can be installed and locked in different manners, as long as they do not interfere with one another.

The dining chair described in the embodiments above has at least one of the following beneficial effects. By inserting the seat into different slide grooves in the support legs, the height of the seat can be adjusted or the seat can be removed and replaced. After the locking member moves to a desired position, it abuts against the rear face of one support leg, thereby preventing the seat from leaving the installation position, and the structure is simple, stable and reliable.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A dining chair comprising:

a pair of support legs comprising inner surfaces that face each other, the inner surfaces defining at least one pair of slide grooves that face each other, each of the at least one pair of slide grooves extending along a direction that is parallel to a surface where the support legs rest;

a seat comprising a front end, a rear end, and two opposite sides between the front end and the rear end, at least one of the sides comprising a first side, a second side, and a shoulder formed between the first side and the second side, the first side slidably received in one of the slide grooves, and the shoulder abutting against a closed end of the one of the slide grooves; and at least one locking mechanism fixed to the seat adjacent to the at least one of the sides of the seat, the at least one locking mechanism comprising a locking member that is configured to move past the second side and abut against a rear end face of one of the support legs, wherein engagement of the shoulder with the closed end of the one of the slide grooves and engagement of the locking member with the rear end face of the one of the support legs prevent a relative movement of the seat with respect to the support legs.

2. The dining chair of claim 1, wherein the at least one locking mechanism is fixed to a lower surface of the seat that faces the surface.

3. The dining chair of claim 1, wherein the at least one locking mechanism further comprises a base fixed to the seat, the locking member is movably connected to the base, and comprises a first end that is configured to receive an external force and an opposite, second end that is configured to abut against the rear end face of the one of the support legs.

4. The dining chair of claim 3, wherein the locking member is rotatably connected to the base, the first end and the second end are rotatable about an axis of rotation, the second end moves toward the rear end face of the one of the support legs when the first end moves away from the one of the support legs.

5. The dining chair of claim 4, further comprising a coil spring, wherein the base comprises a positioning post, the first end and the coil spring are arranged around the positioning post, and opposite ends of the coil spring abut against the locking member and the base.

6. The dining chair of claim 3, wherein the locking member is slidably connected to the base, and the second end moves toward the rear end face of the one of the support legs when the first end receives a pushing force, and moves away from the rear end face of the one of the support legs when the first end receives a pulling force.

7. The dining chair of claim 6, wherein the locking mechanism comprises a locking pin that is configured to lock the locking member in position with respect to the base.

8. The dining chair of claim 3, wherein the locking member is threadly connected to the base.

9. The dining chair of claim 1, wherein a thickness of the seat is smaller than a height of each of the at least one pair of slide grooves.

* * * * *